US007403449B2

(12) United States Patent
Racine et al.

(10) Patent No.: US 7,403,449 B2
(45) Date of Patent: Jul. 22, 2008

(54) WATCH MOVEMENT INCLUDING A DISPLAY RING HOLDING PLATE

(75) Inventors: Christian Racine, Malleray (CH); Christophe Cattin, Delémont (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 11/845,315

(22) Filed: Aug. 27, 2007

(65) Prior Publication Data

US 2008/0074952 A1 Mar. 27, 2008

(30) Foreign Application Priority Data

Sep. 26, 2006 (EP) ..... 06121273

(51) Int. Cl.
*G04B 19/20* (2006.01)
*G04B 19/24* (2006.01)

(52) U.S. Cl. ..... 368/37; 368/38

(58) Field of Classification Search ..... 368/28, 368/34–38

See application file for complete search history.

(56) References Cited

U.S. PATENT DOCUMENTS

| | | | | |
|---|---|---|---|---|
| 3,893,289 | A | 7/1975 | Giger et al. | |
| 4,188,774 | A * | 2/1980 | Besson | 368/38 |
| 4,257,113 | A * | 3/1981 | Meister et al. | 368/35 |
| 5,566,136 | A | 10/1996 | Schwartz et al. | |
| 6,711,100 | B2 * | 3/2004 | Rochat et al. | 368/35 |
| 6,850,495 | B1 * | 2/2005 | Baum et al. | 370/256 |
| 6,925,032 | B2 * | 8/2005 | Willemin et al. | 368/28 |
| 6,934,221 | B2 * | 8/2005 | Willemin et al. | 368/28 |
| 7,110,326 | B2 * | 9/2006 | Besse | 368/37 |
| 2005/0111302 | A1 | 5/2005 | Willemin et al. | |

FOREIGN PATENT DOCUMENTS

CH 684980 A3 2/1995

OTHER PUBLICATIONS

European Search Report issued in corresponding application No. EP 06 12 1273, completed May 4, 2007.

Search Report issued by the Danish Patent Office against the corresponding Singapore application no. SG 200706286-2, mailed Mar. 27, 2008.

* cited by examiner

*Primary Examiner*—Vit W Miska
(74) *Attorney, Agent, or Firm*—Griffin & Szipi, P.C.

(57) ABSTRACT

The movement (10) includes at least one display ring (12, 14) which is rotatably mounted on a bottom plate (16) and which carries markings that will appear in a display zone (22). The ring (12, 14) is fitted with an inner peripheral toothing (24, 26) which cooperates with drive means (20) and which cooperates with a jumper spring (32, 34). The jumper spring (32, 34) is drawn towards the radial abutment position by an elastic return element (40, 42). A holding plate (48) is secured on the bottom plate (16) so as to retain the jumper spring (32, 34) axially. The holding plate (48) is secured on the bottom plate (16) by a bayonet type assembly. The holding plate (48) includes at least one winding member (58) which cooperates with the stop device (32, 34) during the pivoting of the holding plate (48) from the non fixed angular position thereof to the fixed angular position thereof, so as to arm the associated elastic return element (40, 42).

9 Claims, 3 Drawing Sheets

WATCH MOVEMENT INCLUDING A DISPLAY RING HOLDING PLATE

This application claims priority from European Patent Application No. 06121273.4 filed Sep. 26, 2006, the entire disclosure of which is incorporated herein by reference.

FIELD OF THE INVENTION

The invention concerns a movement for a timepiece comprising a display ring securing plate.

BACKGROUND OF THE INVENTION

The invention concerns more specifically a movement for a timepiece comprising at least one display ring which is rotatably mounted about an axis on bottom a plate and which carries, on the top surface thereof, markings provided in order to appear in a display zone, wherein the ring is fitted with an inner peripheral toothing which cooperates with drive means such that the markings carried by the ring pass into the display zone, and which cooperates with a jumper spring effect stop device, mounted on the bottom plate, able to stop the ring in a determined angular position by abutting radially against the inner toothing, the stop device being drawn towards its radial abutting position by an elastic return element, and wherein a holding plate is secured to the bottom plate so as to retain the stop device axially.

The assembly operations for this type of movement can cause problems, in particular when the holding plate is being secured to the bottom plate. Indeed, the jumper spring and its elastic return element are to be held in position on the bottom plate, in the loaded or wound state, via the holding plate that covers them. Consequently, once the jumper spring and its elastic return element have been mounted, the elastic return element can easily be ejected following a bump or vibration, before the holding plate is completely in place, which complicates assembly operations.

In order to overcome this problem, U.S. Pat. No. 3,893,289 proposes mounting the jumper spring and the elastic return element on the bottom plate prior to the display ring, consequently in the net state and arranging notches in one end of the holding plate so as to allow the display ring to be mounted on the bottom plate after the holding plate has been secured.

It is an object of the present invention to propose an alternative solution to the aforementioned technical problem, while simplifying the assembly operations compared to the solution proposed in U.S. Pat. No. 3,893,289.

SUMMARY OF THE INVENTION

Therefore, the invention proposes a movement of the previously described type, characterized in that the holding plate is secured to the bottom plate by a bayonet type assembly during which the holding plate occupies, on the bottom plate, first of all a first non fixed angular position and then a second fixed angular position, and in that the holding plate comprises at least one winding member which cooperates with the stop device while the holding plate is pivoting from its non fixed angular position to its fixed angular position, so as to wind the associated elastic return element.

Owing to these features, the movement according to the invention is particularly simple to assemble. The use of securing screws for the holding plate is no longer necessary, which simplifies assembly operations and which minimises the number of parts forming the movement. A single operation of pivoting the holding plate both enables it to be secured to the bottom plate and Windsor loads the elastic return element associated with the jumper spring.

Preferably, the holding plate comprises securing tongues which project underneath the bottom face of the holding plate and which cooperate with complementary notches arranged in the bottom plate in order to hold the holding plate axially on the bottom plate. The winding member is formed by a lug that extends projecting underneath the bottom face of the holding plate. This type of holding plate is particularly easy to manufacture, especially from sheet metal by cutting, stamping and bending, or in the form of a moulded part.

According to an advantageous embodiment, the stop device comprises a support leg that cooperates with the inner toothing and an elastic arm that forms the elastic return element, and the stop device is formed in a single piece. This results in easier assembly and easier arrangement of the winding member relative to the stop device.

In an embodiment comprising a top ring and a bottom ring which are superposed axially and which form date rings, each ring comprising an associated stop device, the top ring having at least one open or transparent aperture for revealing the markings carried by the bottom ring, the drive means cooperating with the inner toothings of the rings such that the markings carried by the bottom ring appear in succession in the display zone through the aperture, the top ring remaining immobile, then so that, with the bottom ring immobile, the markings carried by the top ring appear in succession in the display zone, the top ring covering the markings of the bottom ring, advantageously, the stop devices should be superposed axially and pivotably mounted about the same axis/arbour. Moreover, the winding member cooperates with the elastic arms of the two stop devices so as to wind the two stop devices simultaneously, and the pivoting axis/arbour of the stop devices is formed by a stud made in a single piece with the bottom plate. These features contribute towards facilitating the assembly operations of the movement by simplifying the structure thereof. The operating reliability of the movement is also thereby improved.

Advantageously, the holding plate comprises an angular indexing tongue which is fitted with an aperture and which cooperates with an angular indexing stud on the bottom plate such that the indexing stud is accommodated in the aperture at the end of the bayonet assembly in order to block the pivoting of the holding plate about its arbour. The angular indexing tongue extends generally in a radial plane. It comprises a free radial end and an opposite radial end linked to the holding plate by a bending zone. The aperture is delimited circumferentially by two opposite abutment edges, the distance separating the two abutment edges being substantially equal to the diameter of the angular indexing stud. This provides greater accuracy in the angular positioning of the holding plate and secures the holding plate more reliably to the bottom plate, without complicating manufacturing and assembly operations.

BRIEF DESCRIPTION OF THE DRAWINGS

Other features and advantages of the present invention will appear more clearly upon reading the following detailed description, made with reference to the annexed drawings, given by way of non-limiting example and in which.

DETAILED DESCRIPTION OF THE ILLUSTRATIVE EMBODIMENTS

In the following description, similar or identical elements may be designated by the same references.

Figure 1:
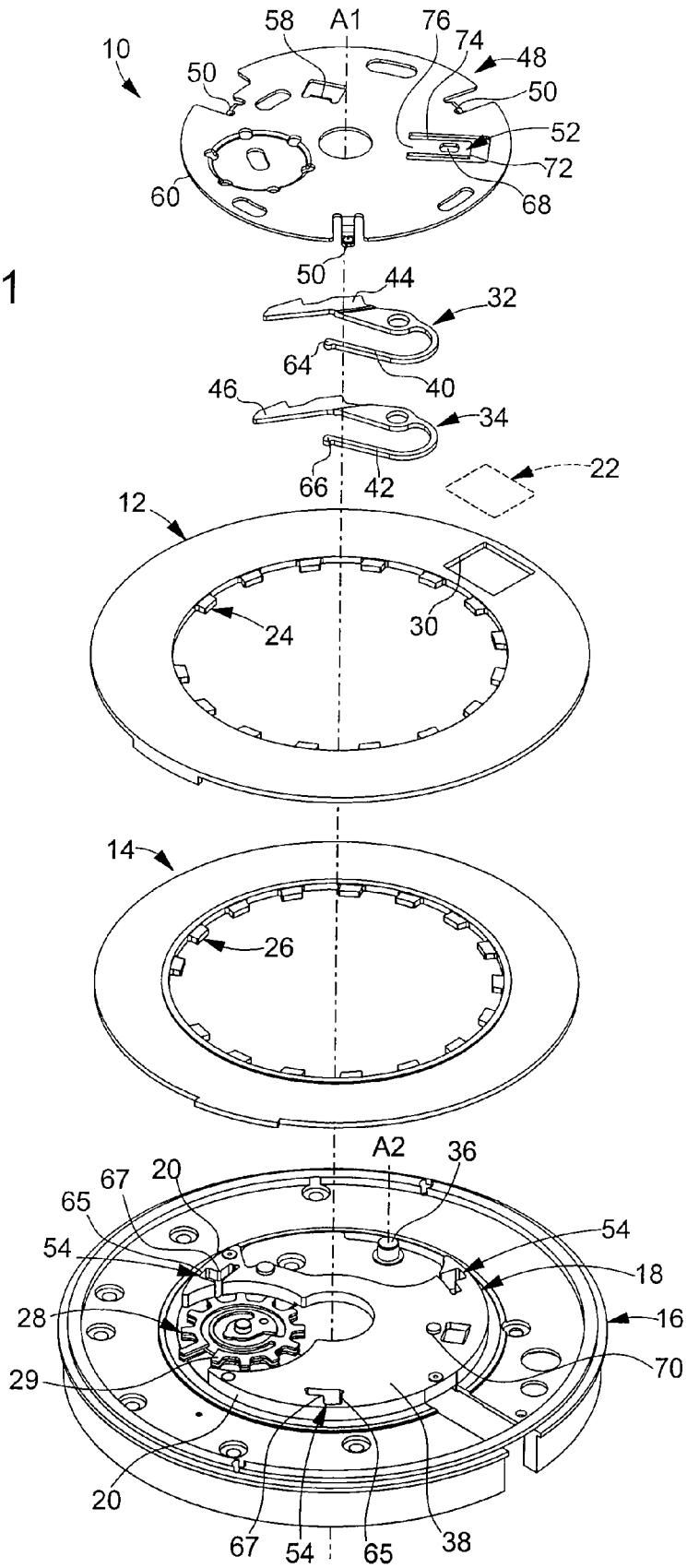
FIG. 1 is an exploded perspective view which shows schematically a timepiece movement with a date display made in accordance with the teaching of the invention.
Figure 2:
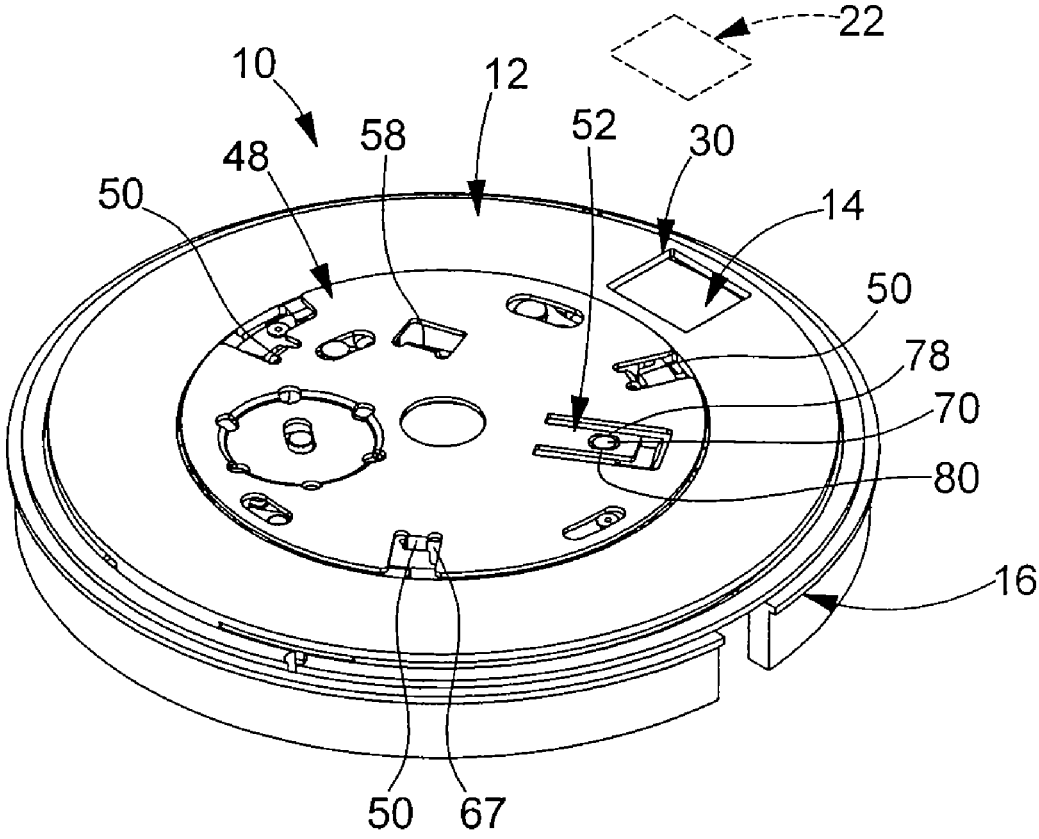
FIG. 2 is a perspective view that shows the movement of FIG. 1 after the holding plate has been secured to the associated bottom plate of the movement.

FIGS. 1 and 2 show schematically and partially a movement 10 for a timepiece such as a wristwatch made in accordance with the teaching of the invention.

In the following description, a vertical axial orientation A1 along the axis of movement 10 will be used, the latter taking here the form of a disc.

According to the embodiment shown, movement 10 is to be fitted to a calendar watch which comprises a date display, this date display being achieved here by means of a top date ring 12 and a bottom date ring 14 which are superposed axially and which are rotatably mounted about axis A1 on a bottom plate 16. Bottom plate 16 comprises here a central platform 18 defining convex cylindrical wall portions 20 which guide rings 12, 14 in rotation.

Each ring 12, 14 carries, on the top face thereof, markings that will appear in a display zone 22 of the watch dial (not shown). Each ring 12, 14 is fitted with an inner peripheral toothing 24, 26 which cooperates with guide means 28 arranged on bottom plate 16 such that the markings carried by each ring 12, 14 pass into display zone 22.

Top ring 12 is provided with an open or transparent aperture 30 which allows the markings carried by bottom ring 14 to appear in display zone 22. Drive means 28 comprise a drive wheel 29 that cooperates with inner toothings 24, 26 of rings 12, 14 such that the markings carried by bottom ring 14 appear in succession in display zone 22 through aperture 30, top ring 12 remaining immobile, then so that, with bottom ring 14 remaining immobile, the markings carried by top ring 12 appear in succession in display zone 22, with top ring 12 covering the markings of bottom ring 14.

The inner toothing 24, 26 of each ring 12, 14 also cooperates with a jumper spring effect stop device 32, 34, which will be designated jumper spring 32, 34, able to stop the associated ring 12, 14 in a determined angular position by abutting radially against the inner toothing 24, 26 thereof. Movement 10 comprises two jumper springs 32, 34 here, which are pivotably mounted about the same stud 36 of vertical axis A2 arranged on bottom plate 16 and which are superposed axially. Stud 36 is made here in a single piece with bottom plate 16.

Each jumper spring 32, 34 is drawn towards its radial abutment position by an elastic return element 40, 42 which is formed here by a elastic arm made in a single piece with the main body 44, 46 of jumper spring 32, 34. The main body 44, 46 of each jumper spring 32, 34 forms a support leg of overall complementary shape to the inner toothing 24, 26 of the associated rings 12, 14.

Of course, according to a variant that is not shown, the elastic return element 40, 42 could be formed by a spring that is distinct from main body 44, 46 of the associated jumper spring 32, 24.

This type of date display system with two superposed rings is described in detail in U.S. Pat. No. 6,925,032 to which reference can be made for more detail, and which is incorporated herein by reference.

A holding plate 48 is secured to bottom plate 16, particularly in order to retain rings 12, 14 and jumper springs 32, 34 axially on bottom plate 16. Here, the holding plate 48 also retains the drive wheel 29 axially on its arbour on bottom plate 16.

Figure 3:
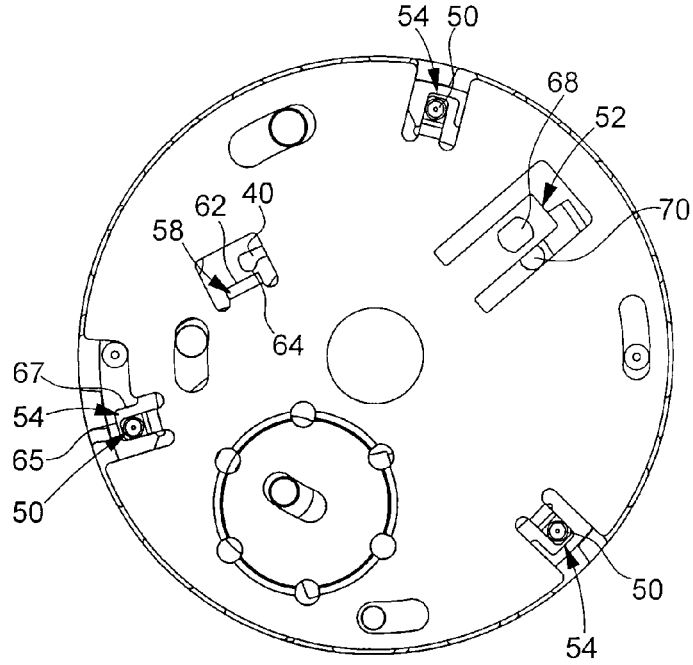
FIG. 3 is a top view that shows the holding plate in the non fixed angular position.
Figure 4:
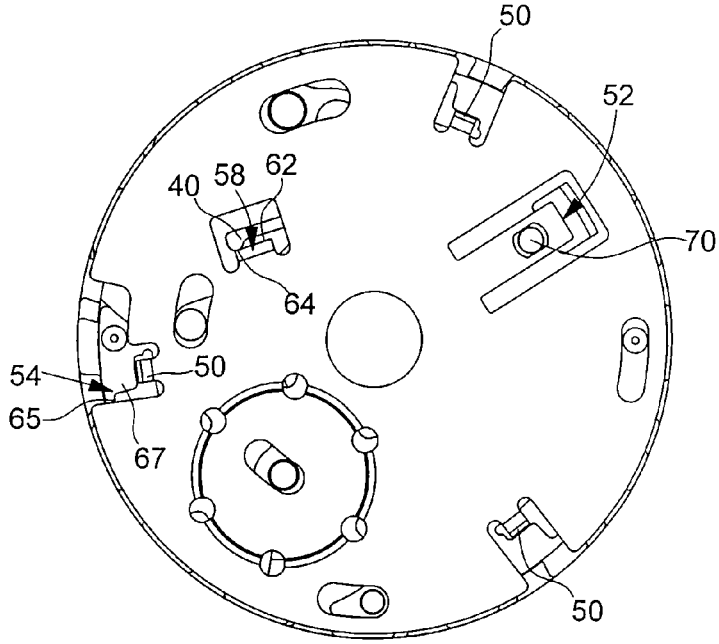
FIG. 4 is a similar view to that of FIG. 3 showing the holding plate in the fixed angular position.

According to an advantageous feature of the invention, a bayonet type assembly secures holding plate 48 to bottom plate 16. Thus, holding plate 48 is provided with securing members 50, which cooperate with complementary elements 54 arranged on bottom plate 16. The assembly of holding plate 48 on bottom plate 16 is achieved by a first movement of axial translation A1 towards the top face 18 of bottom plate 16, then by a second pivoting movement of holding plate 48 relative to bottom plate 16 about axis A1. During the pivoting movement, holding plate 48 first of all occupies a first non fixed angular position, which is shown in FIG. 3, then a second fixed angular position, which is shown in FIGS. 2 and 4, in which securing members 50 cooperate with complementary members 54.

According to another advantageous feature of the invention, holding plate 48 comprises a winding member 58 which cooperates with jumper springs 32, 34 during the pivoting of holding plate 48 from its non fixed angular position to its fixed angular position. Preferably, winding member 58 is formed by a lug 58 that extends projecting underneath bottom face 60 of holding plate 48.

Lug 58, in the form of a plate, extends here in a vertical, overall orthogonal plane to the general plane of holding plate 48. It comprises a control surface 62 oriented generally outwards here, relative to the centre of movement 10, such that control surface 62 is substantially parallel to elastic arms 40, 42 of jumper springs 32, 34, when holding plate 48 occupies its fixed angular position. More specifically, lug 58 and the control surface 62 thereof are arranged such that, in the non fixed angular position of holding plate 48, the abutting end 64, 66 of each elastic arm 40, 42 is at a distance from control surface 62 and such that, in the fixed angular position of holding plate 48, the abutting end 64, 66 of each elastic arm 40, 42 is abutting against control surface 62 which draws jumpers springs 32, 34 to abut radially against inner toothings 24, 26.

One advantage of this embodiment is that only one lug 58 is necessary to simultaneously wind both jumper springs 32, 34. Of course, according to a variant (not shown) of the invention, jumper springs 32, 34 could be pivotably mounted on two different studs 36 and holding plate 48 could comprise two lugs 58 respectively associated with each jumper spring 32, 34, these lugs 58 cooperating simultaneously or in a time staggered manner with the elastic arms 40, 42 of jumper springs 32, 34 in order to wind them.

Preferably, securing members 50 are formed here by three L-shaped securing tongues 50 which project underneath bottom face 60 of holding plate 48 and which are provided to be received in the complementary members 54 formed by notches 54 arranged in platform 18 of bottom plate 16 in order to hold holding plate 48 axially on bottom plate 16. For this purpose, each notch 54 comprises an aperture or entry 65 for the axial insertion of the associated securing tongue 50 and an edge 67 underneath which the free end of the L of securing tongue 50 is positioned, when holding plate 48 occupies its fixed angular position.

Advantageously, holding plate 48 comprises an angular indexing tongue 52 which is provided with an aperture 68 and which cooperates by snap fit with an angular indexing stud 70 arranged on platform 18 such that indexing stud 70 is received in aperture 68 at the end of the bayonet assembly, in order to block the pivoting of holding plate 48 about is axis A1 in the fixed angular position.

Indexing tongue 52 extends here in a radial plane identical to the general plane of holding plate 48. It comprises a free radial end 72 and an opposite radial end 74 which is linked to holding plate 48 by a bending zone 76. Aperture 68 is delimited circumferentially by two opposite abutment edges 78, 80, the distance separating the two abutment edges 8, 80 being substantially equal to the diameter of angular indexing stud 70.

Preferably, holding plate 48 is made of sheet metal by cutting, stamping and bending, which enables securing tongues 50, indexing tongue 52 and lug 58 to be made in one piece with holding plate 48 in a simple and economical manner. Of course, according to a variant, holding plate 48 could be made by metal moulding or in a plastic material.

The assembly operations of movement 10 according to the invention will now be described. The two rings 12, 14 are placed on bottom plate 16, guided axially by cylindrical wall portions 20, and the two jumper springs 32, 34 are fitted onto the associated stud 36. At this stage of assembly, the elastic arms 40, 42 of jumper springs 32, 34 are in the rest state, i.e. not compressed, and jumper springs 32, 34 are not being drawn to abut radially against the inner toothings 24, 26 of rings 12, 14. It will be noted that rings 12, 14 can be mounted on plate 16 before or after jumper springs 32, 34.

Holding plate 48 is then placed on platform 18 of bottom plate 16 such that securing tongues 50 can be axially inserted (A1) into apertures 65 of notches 54. Holding plate 48 then occupies its non fixed angular position. At this stage, elastic arms 40, 42 are still in the rest state and indexing tongue 52 is shifted angularly relative to indexing stud 70, which corresponds to the diagram of FIG. 3.

Holding plate 48 is then pivoted by a few degrees about its axis A1, relative to bottom plate 16, in the clockwise direction looking at the Figures, until it occupies its fixed angular position which is shown in FIGS. 2 and 4. In this fixed angular position, elastic tongues 40, 42 are wound and abutting against winding lug 58, securing tongues 50 are placed underneath edge 67 of the associated notches 54, which retains holding plate 48 axially on bottom plate 16, and indexing stud 70 is received in aperture 68 of indexing tongue 52, which immobilizes holding plate 48 angularly.

During the pivoting of holding plate 48, lug 58 progressively abuts against the abutment ends 64, 66 of elastic arms 40, 42, which winds jumper springs 32, 34 by drawing them elastically against the associated inner toothings 24, 26.

It will be noted that holding plate 48 can be easily dismantled. Indexing tongue 52 needs only to be bent slightly upwards to release it from indexing stud 70, then holding plate 48 needs to be pivoted in the opposite direction to its non fixed angular position.

What is claimed is:

1. A movement for a timepiece including at least one display ring which is rotatably mounted about an axis on a bottom plate and which carries, on the top face thereof, markings that will appear in a display zone, wherein the ring is fitted with an inner peripheral toothing which cooperates with drive means such that the markings carried by the ring pass into the display zone, and which cooperates with a stop device by the effect of a jumper spring, mounted on the bottom plate, able to stop the ring in a determined angular position by abutting radially against the inner toothing, the stop device being drawn towards the radial abutment position thereof by an elastic return element, and wherein a holding plate is secured on the bottom plate so as to retain the stop device axially, wherein the holding plate is secured on the bottom plate by a bayonet type assembly during which the holding plate occupies, on the bottom plate, first of all a first non fixed angular position, then a second fixed angular position, and wherein the holding plate includes at least one winding member which cooperates with the stop device during the pivoting of the holding plate from the non fixed angular position thereof to the fixed angular position thereof, so as to wind the associated elastic return element.

2. The movement according to claim 1, wherein the holding plate includes securing tongues which project underneath the bottom face of the holding plate and which cooperate with complementary notches arranged in the bottom plate to retain the holding plate axially on the bottom plate.

3. The movement according to claim 1, wherein the winding member is formed by a lug which extends projecting underneath the bottom face of the holding plate.

4. The movement according to claim 1, wherein the stop device includes an abutment foot which cooperates with the inner toothing and an elastic arm which forms the elastic return element, and in that the stop device is made in a single piece.

5. The movement according to claim 4, including a top ring and a bottom ring which are superposed axially and which form date rings, each ring including an associated stop device, the top ring having at least one open or transparent aperture for showing the markings carried by the bottom ring, the drive means cooperating with the inner toothings of the rings such that the markings carried by the bottom ring appear in succession in the display zone through the aperture, the top ring remaining immobile, then, such that, when the bottom ring is immobile, the markings carried by the top ring appear in succession in the display zone, the top ring covering the markings of the bottom ring, wherein the stop devices are superposed axially and they are pivotably mounted about the same axis, and in that the winding member cooperates with the elastic arms of the two stop devices so as to wind the two stop devices simultaneously.

6. The movement according to claim 5, wherein the pivoting axis of the stop devices is formed by a stud made in a single piece with the bottom plate.

7. The movement according to claim 1, wherein the holding plate includes an angular indexing tongue which is fitted with an aperture and which cooperates with an angular indexing stud arranged on the bottom plate such that the indexing stud is received in the aperture at the end of the bayonet assembly in order to block the pivoting of the holding plate about the axis thereof.

8. The movement according to claim 7, wherein the angular indexing tongue extends overall in a radial plane, wherein said movement includes a free radial end and an opposite radial end linked to the holding plate by a bending zone, wherein the aperture is delimited circumferentially by two opposite abutment edges, the distance separating the two abutment edges being substantially equal to the diameter of the angular indexing stud.

9. The movement according to claim 2, wherein the winding member is formed by a lug which extends projecting underneath the bottom face of the holding plate.

* * * * *